US008105032B2

(12) United States Patent
Bracken et al.

(10) Patent No.: US 8,105,032 B2
(45) Date of Patent: Jan. 31, 2012

(54) SYSTEMS AND METHODS FOR INTERNALLY COOLING A WHEEL OF A STEAM TURBINE

(75) Inventors: Robert James Bracken, Niskayuna, NY (US); Michael Earl Montgomery, Niskayuna, NY (US); Stephen Roger Swan, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1032 days.

(21) Appl. No.: 12/025,429

(22) Filed: Feb. 4, 2008

(65) Prior Publication Data

US 2009/0196735 A1 Aug. 6, 2009

(51) Int. Cl.
*F01D 5/08* (2006.01)

(52) U.S. Cl. ..... 416/97 R; 415/115

(58) Field of Classification Search ..... 415/115, 415/116; 416/91, 92, 93 R, 96 R, 97 R
See application file for complete search history.

(56) References Cited

U.S. PATENT DOCUMENTS

| | | | | |
|---|---|---|---|---|
| 3,189,320 | A * | 6/1965 | Beldecos | 415/93 |
| 3,291,447 | A * | 12/1966 | Brandon | 415/111 |
| 3,443,790 | A * | 5/1969 | Buckland | 415/115 |
| 4,551,063 | A * | 11/1985 | Raschke et al. | 415/115 |
| 6,010,302 | A * | 1/2000 | Oeynhausen | 415/115 |
| 6,227,799 | B1 * | 5/2001 | Kuhn et al. | 415/115 |
| 6,364,613 | B1 * | 4/2002 | Deallenbach et al. | 416/220 R |
| 7,267,525 | B2 * | 9/2007 | Hiegemann et al. | 415/115 |
| 2007/0110571 | A1 | 5/2007 | Bracken et al. | |

* cited by examiner

*Primary Examiner* — Igor Kershteyn
(74) *Attorney, Agent, or Firm* — Sutherland Asbill & Brennan LLP

(57) ABSTRACT

A system may cool a wheel of a steam turbine, the wheel being associated with a rotor of the steam turbine. The system may include an inlet passage and an outlet passage. The inlet passage may be positioned to communicate steam from an exterior of the rotor, through an interior of the rotor, and to the wheel. The outlet passage may be positioned to communicate steam from the wheel, through the interior of the rotor, and to the exterior of the rotor.

17 Claims, 3 Drawing Sheets

SYSTEMS AND METHODS FOR INTERNALLY COOLING A WHEEL OF A STEAM TURBINE

TECHNICAL FIELD

The present disclosure generally relates to systems and methods for cooling a wheel of a steam turbine and more particularly relates to systems and methods for internally cooling a wheel of a steam turbine.

BACKGROUND OF THE INVENTION

Steam turbines extract work from steam to generate power. A typical steam turbine may include a rotor associated with a number of wheels. The wheels may be spaced apart from each other along the rotor, defining a series of stages. The stages are designed to efficiently extract work from steam traveling on a flow path from an entrance to an exit of the turbine. As the steam travels along the flow path, the steam may cause the wheels to drive the rotor. The steam may gradually expand, and the temperature and pressure of the steam may gradually decrease. The steam is then exhausted from the exit of the turbine.

Higher-temperature steam turbines may generate increased output, as the increased temperature of the steam may increase the energy available for extraction in the stages. For example, a reheat steam turbine may include a high-pressure (HP) section, an intermediate pressure (IP) section, and a low-pressure (LP) section. The sections may be arranged in series with each section including stages. Within the sections, work is extracted from the steam to drive the rotor. Between the sections, the steam may be reheated to recondition the steam for performing work in the next section. The HP and IP sections may operate at relatively high temperatures, increasing the turbine output.

Although higher-temperature steam turbines may be capable of increased output, the higher-temperatures may challenge the materials used to form the turbine components. For example, the rotor may include a series of integral dovetails that permit joining buckets to the wheels. At higher temperatures, the attachment area of the dovetail and the bucket may experience stress, risking creep or failure. One solution may be to form the rotor and associated dovetails from materials selected to withstand higher temperatures. However, such materials tend to be relatively expensive and may be relatively difficult to manufacture in the desired geometry. Another solution may be to cool the attachment area using steam that is externally routed to the attachment area. However, such steam has not performed work elsewhere in the turbine, and therefore employing such steam for cooling purposes is inefficient and may cause performance losses. From the above, it is apparent that a need exists for systems and methods of cooling the wheel of a steam turbine, and more specifically the attachment area at which the wheel is joined to the rotor.

BRIEF DESCRIPTION OF THE INVENTION

A system may cool a wheel of a steam turbine, the wheel being associated with a rotor of the steam turbine. The system may include an inlet passage and an outlet passage. The inlet passage may be positioned to communicate steam from an exterior of the rotor, through an interior of the rotor, and to the wheel. The outlet passage may be positioned to communicate steam from the wheel, through the interior of the rotor, and to the exterior of the rotor.

The inlet passage may include an inlet opening located downstream of the wheel. The outlet passage may include an outlet opening located downstream of the wheel. The inlet opening may be located upstream of the outlet opening, such that a pressure differential is created between the inlet opening and the outlet opening, the inlet opening being at a relatively higher pressure than the outlet opening.

An annular channel may be formed about the wheel. The inlet passage may be in communication with an intake into the annular channel. The outlet passage may be in communication with an outtake out of the annular channel.

The inlet passage may include an axial inlet channel, a downstream radial inlet channel, and a upstream radial inlet channel. The axial inlet channel may extend through the interior of the rotor. The downstream radial inlet channel may connect the exterior of the rotor to the axial inlet channel. The upstream radial inlet channel may connect the axial inlet channel to the wheel. The outlet passage may include an axial outlet channel, an upstream radial outlet channel, and a downstream radial outlet channel. The axial outlet channel may extend through the interior of the rotor. The upstream radial outlet channel may connect the wheel to the axial outlet channel. The downstream radial outlet channel may connect the axial outlet channel to the exterior of the rotor. An annular channel may be formed about the wheel. The annular channel may extend circumferentially about the wheel between the upstream radial inlet channel and the upstream radial outlet channel.

The system may also include an axial bore and a tube. The axial bore may extend substantially along a longitudinal axis of the rotor. The tube may be positioned in the axial bore. An interior of the tube may define a portion of the inlet passage. A space between the tube and the axial bore may define a portion of the outlet passage. The axial bore may be substantially cylindrical. The tube may be substantially cylindrical. A diameter of the tube may be relatively smaller than a diameter of the axial bore. The tube may be concentrically mounted in the axial bore.

In embodiments, a system may cool an attachment area of a steam turbine. The system may include an annular channel and an internal cooling path. The annular channel may extend circumferentially about the attachment area of a rotor. The internal cooling path may be formed through an interior of the rotor. The internal cooling path may extend from an inlet opening through the annular channel to an outlet opening.

The annular channel may be located upstream of the inlet opening and the outlet opening. The inlet opening may be located upstream of the outlet opening.

The internal cooling path may include a first axial channel, a second axial channel, a first radial channel, a second radial channel, a third radial channel, and a fourth radial channel. The first axial channel may be on an interior of the rotor. The second axial channel may be on the interior of the rotor. The second axial channel may be separated from the first axial channel. The first radial channel may extend from an exterior of the rotor to the first axial channel. The second radial channel may extend from the first axial channel to an intake of the annular channel. The third radial channel may extend from an outtake of the annular channel to the second axial channel. The fourth radial channel may extend from the second axial channel to the exterior of the rotor.

The internal cooling path may include an axial bore, a tube, a number of downstream radial channels, and a number of upstream radial channels. The axial bore may extend axially through an interior of the rotor. The tube may be concentrically mounted in the axial bore. The tube may separate the axial bore into two discrete passageways. The downstream radial channels may extend radially outward from the axial bore to the surface of the rotor. The upstream radial channels may extend radially outward from the axial bore to the annular channel.

In embodiments, a system for cooling a turbine may include an annular channel and an internal cooling path. The annular channel may extend circumferentially about a wheel of the turbine. The internal cooling path may be through an interior of a rotor of the turbine. The internal cooling path may include an inlet passage and an outlet passage. The inlet passage may be positioned to communicate steam from a first downstream wheel space to the annular channel. The outlet passage may be positioned to communicate steam from the annular channel to a second downstream wheel space. The second downstream wheel space may be farther downstream than the first downstream wheel space, such that a pressure drop is created along the internal cooling path when the turbine is in operation. The annular channel may extend circumferentially about the wheel adjacent a dovetail of the rotor.

The system may include an axial bore and a tube. The axial bore may extend through the interior of the rotor. The tube may be concentrically mounted in the axial bore. The tube may separate the axial bore into two discrete passageways. One of the discrete passageways may form a portion of the inlet passage and the other of the discrete passageways may form a portion of the outlet passage.

The system may include a number of radial channels extending through the rotor. The inlet passage may include some of the radial channels and the outlet passage may include the other radial channels.

The inlet passage may include an axial inlet channel, a downstream radial inlet channel, and an upstream radial inlet channel. The axial inlet channel may extend through the interior of the rotor. The downstream radial inlet channel may connect the first downstream wheel space to the axial inlet channel. The upstream radial inlet channel may connect the axial inlet channel to an intake of the annular channel. The outlet passage may include an axial outlet channel, an upstream radial outlet channel, and a downstream radial outlet channel. The axial outlet channel may extend through the interior of the rotor. The upstream radial outlet channel may connect an outtake of the annular channel to the axial outlet channel. The downstream radial outlet channel may connect the axial outlet channel to the second downstream wheel space.

The internal cooling path may include a first axial channel, a second axial channel, a first radial channel, a second radial channel, a third radial channel, and a fourth radial channel. The first axial channel may be on the interior of the rotor. The second axial channel may be on the interior of the rotor. The second axial channel may be separated from the first axial channel. The first radial channel may extend from the first downstream wheel space to the first axial channel. The second radial channel may extend from the first axial channel to an intake of the annular channel. The third radial channel may extend from an outtake of the annular channel to the second axial channel. The fourth radial channel may extend from the second axial channel to the second downstream wheel space.

Other systems, devices, methods, features, and advantages of the disclosed systems and methods for internally cooling a wheel of a steam turbine will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE DRAWINGS

The present disclosure may be better understood with reference to the following figures. Matching reference numerals designate corresponding parts throughout the figures, and components in the figures are not necessarily to scale.

DETAILED DESCRIPTION OF THE INVENTION

Described below are embodiments of systems and methods for internally cooling a wheel of a steam turbine. The systems and methods may employ steam from the turbine to cool the wheel. The cooling steam may be internally routed from a "downstream" stage of the turbine to an "upstream" stage of the turbine. The downstream steam may have already performed work in upstream stages of the turbine. Therefore, the downstream steam may be relatively cooler than the wheels of the upstream stages. Such cooler steam may be internally routed through the rotor of the turbine to the attachment area of the wheel so that the cooler steam may cool the wheel. After the wheel has been cooled, the steam may be internally routed back through the interior of the rotor to an outlet at a downstream end of the turbine. Thereby, the attachment area may be cooled using steam that is a byproduct of turbine operation.

Figure 1:
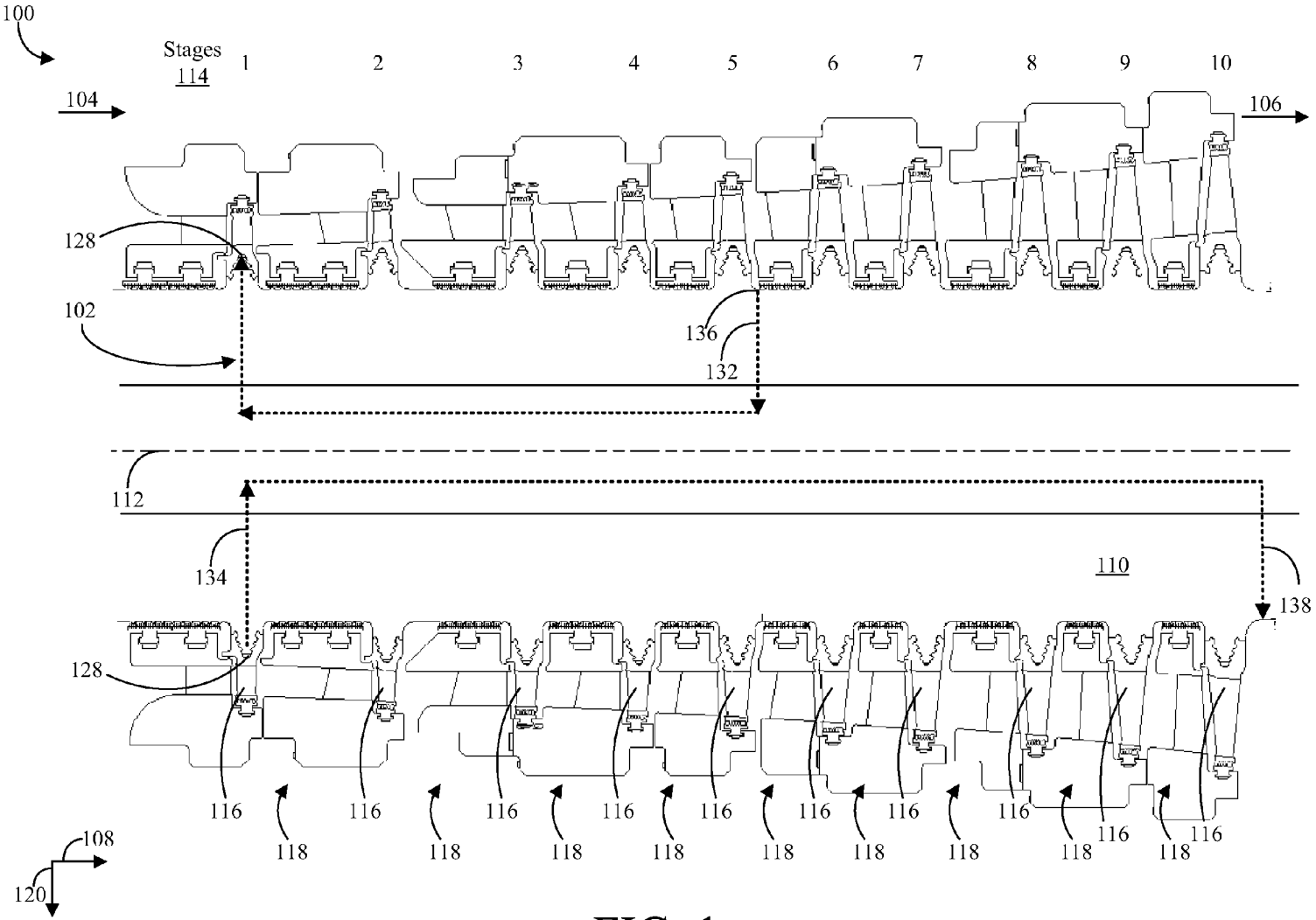
FIG. 1 is a cross-sectional view of a steam turbine, schematically illustrating an embodiment of an internal cooling path of the steam turbine.

Turning to the figures, FIG. 1 is a cross-sectional view of a portion of a steam turbine 100, schematically illustrating an embodiment of an internal cooling path 102 of the steam turbine 100. The steam turbine 100 may be a high-temperature steam turbine 100, such as an HP or IP section of a reheat turbine. Any other steam turbine 100 may be used. The steam turbine 100 may include an entrance 104 and an exit 106. The entrance 104 may be in communication with, for example, a boiler that provides steam to the turbine 100 (not shown). The exit 106 may be in communication with, for example, a boiler that reheats the steam for use in a subsequent section of the turbine 100, although other configurations are possible. For example, the exit 106 may exhaust steam from the turbine 100. A flow path may be defined through the turbine 100 from the entrance 104 to the exit 106. The flow path may extend in a longitudinal direction 108. A rotor 110 may extend along the flow path through the turbine 100. The rotor 110 may have a longitudinal axis 112 that is substantially parallel to the longitudinal direction 108.

A number of stages 114 may be defined along the flow path. In FIG. 1, the stages 114 are numbered for clarity. Each stage 114 may include a wheel 116 associated with the rotor 110. The wheels 116 may be spaced apart from each other along the longitudinal axis 112 of the rotor 110 and a wheel space 118 may be defined between two wheels 116. The wheels 116 may extend outward from the rotor 110 in a radial direction 120. The wheels 116 may be, for example, substantially perpendicular to the longitudinal direction 108. The illustrated turbine 100 includes ten wheels 116 and therefore ten stages 114, although the turbine 100 may have any number of wheels 116 and stages 114 in other embodiments.

Figure 2:
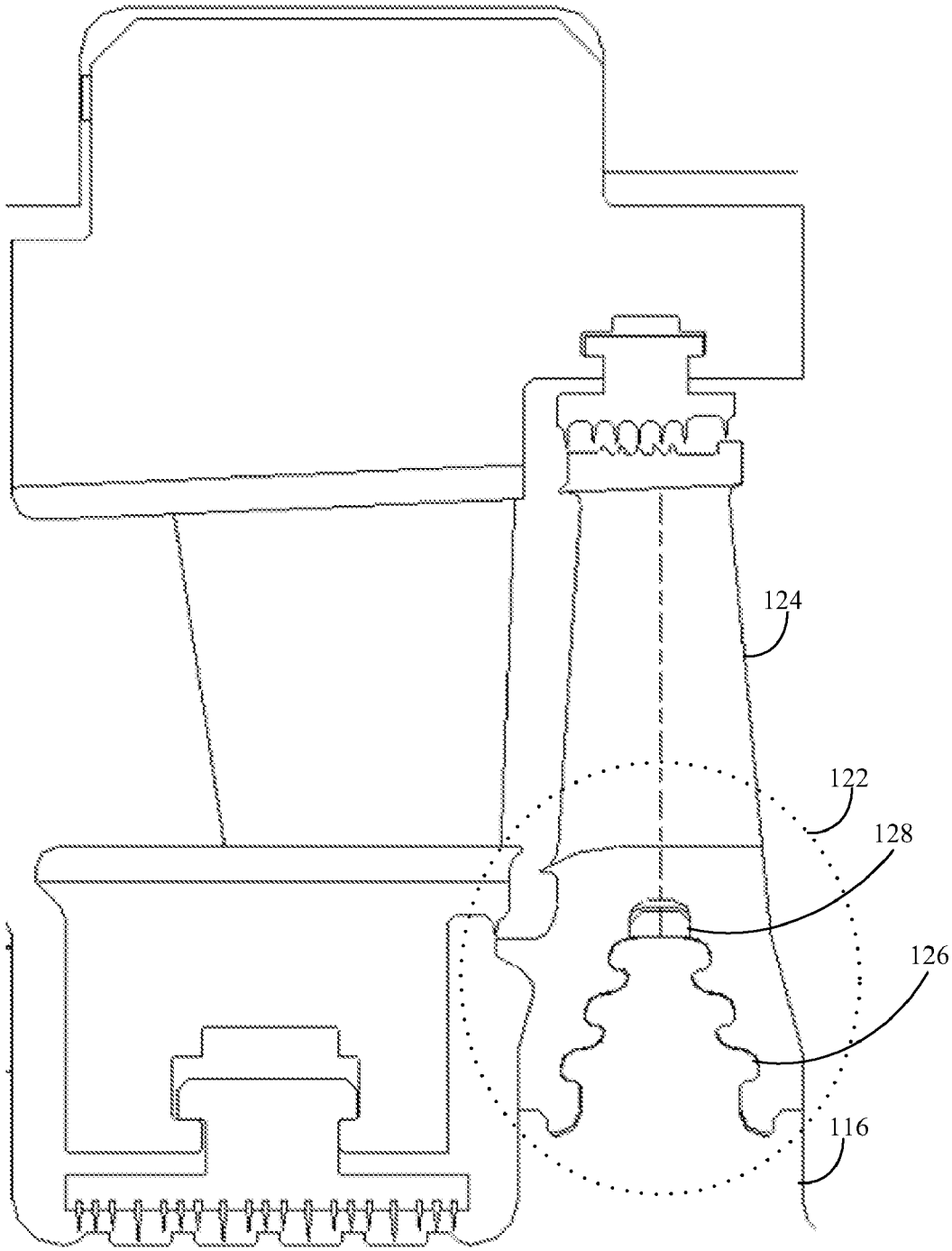
FIG. 2 is a partial cross-sectional view an embodiment of the steam turbine of FIG. 1, illustrating an attachment area at which a bucket is joined to a dovetail of a wheel.

FIG. 2 is a partial cross-sectional view of the steam turbine 100, illustrating an attachment area 122 at which a bucket 124 is joined to the wheel 116. Specifically, a dovetail 126 may be, for example, integrally formed on the wheel 116. The dovetail 126 may facilitate joining the bucket 124 to the wheel 116, so that rotation of the bucket 124 is imparted on the rotor 110 by the wheel 116. The illustrated dovetail 126 is a tangential-entry dovetail having a tree-type shape, but the dovetail 126 may have any other shape or configuration. As shown in FIG. 2, a slight gap or opening is formed between the bucket 124 and the dovetail 126. The slight gap or opening may define an annular channel 128 that extends circumferentially about the attachment area 122 between the bucket 124 and the dovetail 126.

With reference to FIG. 1, steam enters the turbine 100 at the entrance 104 and travels downstream along the flow path to the exit 106. For purposes of this disclosure, the term "downstream" indicates a direction extending away from the entrance 104 of the turbine 100 toward the exit 106, while the term "upstream" denotes a direction extending away from the exit 106 of the turbine 100 toward the entrance 104. As the steam travels downstream, the steam expands and the pressure and temperature of the steam decreases. Due to the decreasing pressure, each downstream stage 114 may be relatively lower in pressure than corresponding upstream stages 114. Further, each downstream stage 114 may be relatively lower in temperature than F corresponding upstream stages 114. Therefore, steam from a downstream stage 114 may be routed to the components of an upstream stage 114 to cool the components, such as the bucket 124 and the dovetail 126 in the attachment area 122.

To facilitate routing the cooler steam to and from the upstream stage 114, the internal cooling path 102 may be defined through an interior of the rotor 110. Generally, the internal cooling path 102 may include an inlet passage 132 and an outlet passage 134. The inlet passage 132 may be positioned to communicate steam from the downstream stage 114 to the upstream stage 114. For example, the inlet passage 132 may extend from an inlet opening 136 located in the wheel space 118 of a downstream stage 114 to the annular channel 128 located in the attachment area 122 of an upstream stage 114. The inlet opening 136 may be in communication with, for example, an exterior of the rotor 110. Between the inlet opening 136 and the annular channel 128, the inlet passage 132 may extend through the interior of the rotor 110.

The outlet passage 134 may be adapted to communicate steam from the upstream stage 114 to a downstream stage 114. For example, the outlet passage 134 may extend from the annular channel 128 to an outlet opening 138. The outlet opening 138 may be in communication with the exterior of the rotor 110 in the wheel space 118 of the downstream stage 114. Between the annular channel 128 and the outlet opening 138, the outlet passage 134 may extend through the interior of the rotor 110. Within the interior of the rotor 110, the outlet passage 134 may be separated from the inlet passage 132 by, for example, a wall (not shown in FIG. 1).

The internal cooling path 102 permits routing relatively lower temperature downstream steam to relatively higher temperature upstream components for cooling purposes. For example, steam from a downstream wheel space 118 may be routed to the annular channel 128 in the attachment area 122 of an upstream stage 114. The steam may travel through the inlet opening 136 in the wheel space 118 of the downstream stage 114, along the inlet passage 132 on the interior of the rotor 110, and to the annular channel 128 of the upstream stage 114. The steam may then travel circumferentially along the annular channel 128, accepting heat from the dovetail 126 and the bucket 124 to reduce the temperature of the attachment area 122. The steam may then travel from the annular channel 128 of the upstream stage 114, along the outlet passage 134 on the interior rotor 110, and to the outlet opening 138 in the wheel space 118 of the downstream stage 114.

In embodiments in which the internal cooling path 102 is a closed path, the outlet opening 138 may be located downstream of the inlet opening 136. Such positioning may create a pressure differential across the internal cooling path 102 that pulls steam along the internal cooling path 102. As mentioned above, the pressure within the turbine 100 may gradually decrease along the flow path, and therefore steam in an upstream stage 114 may be relatively higher in pressure than steam in a corresponding downstream stage 114. Thus, when the inlet opening 136 is located upstream, the pressure at the inlet opening 136 may be relatively higher than the pressure at the outlet opening 138. The pressure differential may drive steam through the internal cooling path 102 from the inlet opening 136 to the outlet opening 138, although other configurations are possible. For example, a pump or a similar type of transfer device may be employed.

In the illustrated embodiment, the internal cooling path 102 routes steam from the fifth stage to the first stage, and from the first stage to the tenth stage. However, the illustrated internal cooling path 102 is merely one example and other internal cooling paths 102 may be encompassed within the scope of the present disclosure. More specifically, the internal cooling path 102 may route steam from any stage 114 that is relatively farther downstream to any stage 114 that is relatively father upstream, such that the steam may be employed for cooling purposes. The internal cooling path 102 may then route the steam from the relatively farther upstream stage 114 to any stage 114 that is relatively farther downstream, such that the steam can be exhausted from the turbine 100 or recycled for use in subsequent turbine sections. In some cases, the internal cooling path 102 may route steam to multiple upstream stages 114 for the purpose of cooling multiple attachment areas 122. In such cases, the inlet and outlet passages 132, 134 may communicate with multiple annular channels 128. In fact, the internal cooling path 102 may extend between different sections of the turbine 100. For example, a reheat turbine may include multiple sections that operate at different temperatures and pressures. Steam from an LP or IP section of the reheat turbine may be routed to the HP section of the turbine 100 to cool a stage 114 of the HP section. In such cases, the internal cooling path 102 may cross a coupling of the rotor 110 at an end of the section.

Figure 3:
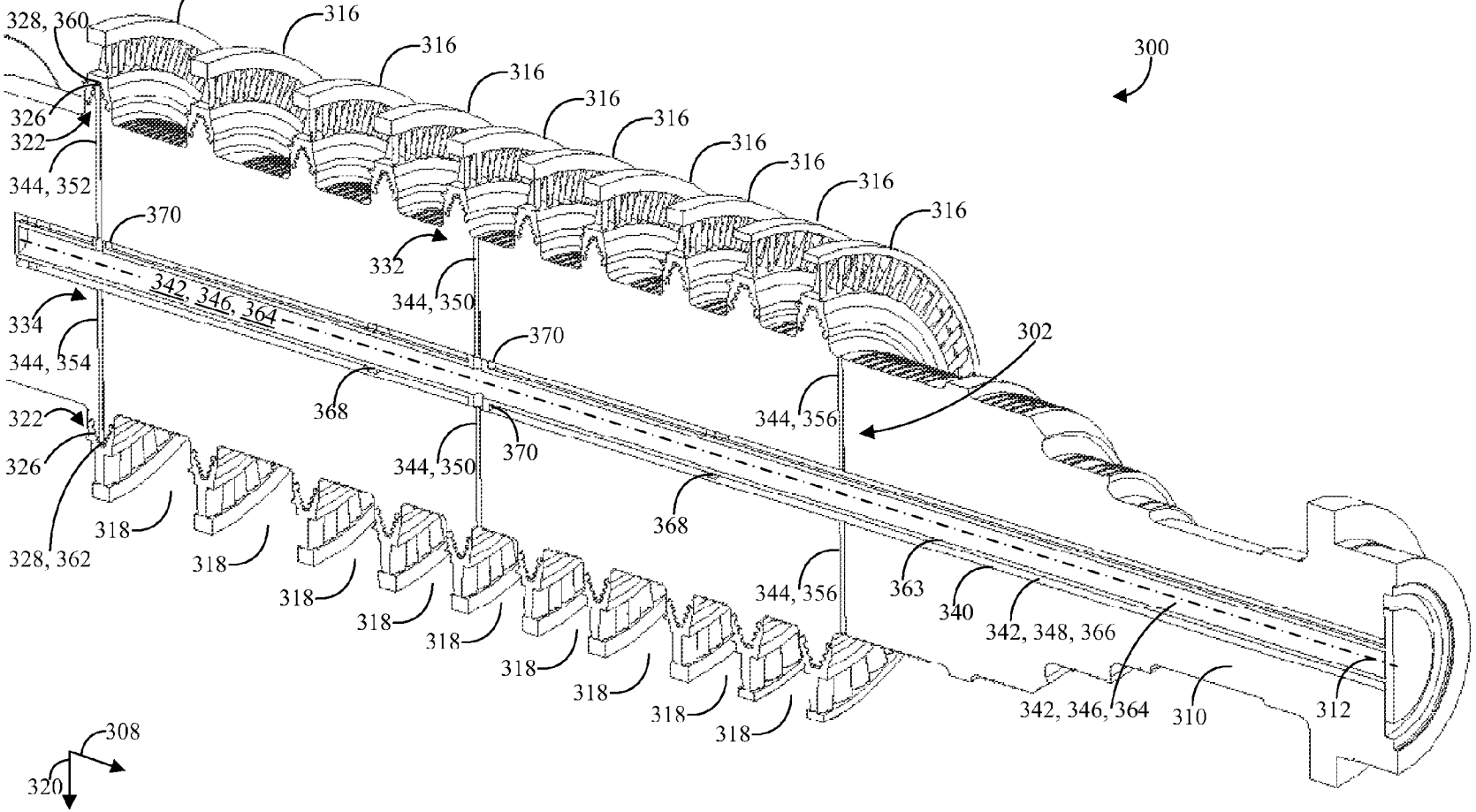
FIG. 3 is a perspective, cut-away view of an embodiment steam turbine, illustrating another embodiment of an internal cooling path.

FIG. 3 is a perspective, cut-away view of an embodiment steam turbine 300, illustrating another embodiment of an internal cooling path 302. As shown, the internal cooling path 302 may include an axial bore 340, a number of axial channels 342 in the axial bore 340, and a number of radial channels 344 in a rotor 310. The axial bore 340 may extend through an interior of the rotor 310 in substantially a longitudinal direction 308. To facilitate balanced rotation of the rotor 310, the axial bore 340 may be substantially cylindrical in shape and may be substantially aligned with a longitudinal axis 312 of the rotor 310.

The axial channels 342 may include an axial inlet channel 346 and an axial outlet channel 348. The axial channels 342 may be separated by, for example, a wall. Embodiments of axial channels 342 are described in further detail below, although any configuration is possible.

The radial channels 344 may be formed through the rotor 310. The radial channels 344 may extend in substantially a radial direction 320 from the exterior of the rotor 310 to the axial bore 340. As shown, the radial channels 344 include a downstream radial inlet channel 350, an upstream radial inlet channel 352, an upstream radial outlet channel 354, and a downstream radial outlet channel 356.

The downstream radial inlet channel 350 may be located in a downstream wheel space 318, extending from the exterior of the rotor 310 to the axial inlet channel 346 in the axial bore 340. Thus, the downstream radial inlet channel 350 permits communicating steam from the downstream wheel space 318 to the axial inlet channel 346. Two downstream radial inlet channels 350 are shown for illustrative purposes, although one may be omitted.

The upstream radial inlet channel 352 may be located adjacent an upstream wheel 316, extending from the axial inlet channel 346, though a dovetail 326, and to an intake 360 into an annular channel 328 between the dovetail 326 and the wheel 316. Thus, the upstream radial inlet channel 352 permits communicating steam from the axial inlet channel 346 to the intake 360 of the annular channel 328.

The upstream radial outlet channel 354 may be located adjacent the upstream wheel 316, extending from an outtake 362 of the annular channel 328 to the axial outlet channel 348 in the axial bore 340. Thus, the upstream radial outlet channel 354 may permit communicating steam from the outtake 362 of the annular channel 328 to the axial outlet channel 348 of the axial bore 340.

The downstream radial outlet channel 356 may be located in a downstream wheel space 318, extending from the axial outlet channel 348 in the axial bore 340 to the exterior of the rotor 310. Thus, the downstream radial outlet channel 356 may permit communicating steam from the axial outlet channel 348 to the exterior of the rotor 310 in the downstream wheel space 318. Two downstream radial outlet channels 356 are shown for illustrative purposes, although one may be omitted.

Together, the axial channels 342 and the radial channels 344 may form the internal cooling path 302. Specifically, an inlet passage 332 may include the downstream radial inlet channel 350, the axial inlet channel 346, and the upstream radial inlet channel 352. The inlet passage 332 permits communicating steam from the downstream wheel space 318 to the intake 360 into the upstream annular channel 328. Further, an outlet passage 334 may include the upstream radial outlet channel 354, the axial outlet channel 348, and the downstream radial outlet channel 356. The outlet passage 334 permits communicating steam from the outtake 362 of the upstream annular channel 328 to the downstream wheel space 318.

As shown, the downstream radial inlet channels 350 may be located upstream of the downstream radial outlet channels 356. Thus, a pressure differential may be formed across the internal cooling path 302. The pressure differential may drive steam through the annular channel 328 for cooling purposes, as described above.

In embodiments, the axial inlet channel 346 and the axial outlet channel 348 may be concentrically disposed within the axial bore 340. For example, a tube 363 may be positioned within the axial bore 340. The tube 363 may extend substantially in the longitudinal direction 308. The tube 363 may be substantially cylindrical in shape and may be substantially aligned with the longitudinal axis 312 of the rotor 310. The tube 363 may have a hollow interior and an outer diameter that is relatively smaller than a diameter of the axial bore 340. The tube 363 may be closed at both ends. Thus, when the tube 363 is concentrically mounted within the axial bore 340 such that the exterior the tube spaced apart from the surface of the axial bore 340, the tube 363 may define isolated passageways within the axial bore 340.

More specifically, the interior of the tube 363 may define an inner passageway 364 that is, for example, substantially cylindrical in shape. The space between the exterior of the tube 363 and the surface of the axial bore 340 may define an outer passageway 366 that is substantially tubular in shape. The passageways 364, 366 may be concentrically positioned with respect to each other and may extend through the interior of the rotor 310 in the longitudinal direction 308. The tube 363 may separate or isolate the passageways 364, 366 from each other.

The tube 363 may be associated with the rotor 310 at select locations along the longitudinal length of the rotor 310. For example, support collars 368 or other suitable devices may mount the tube 363 to the axial bore 340. Thus, rotation of the rotor 310 may be transferred to the tube 363 so that the two spin in unison. In some embodiments, the support collars 368 may be anti-rotation lugs formed on the exterior of the tube 363. The anti-rotation lugs may engage anti-rotation grooves machined on the surface of the axial bore 340, although other configurations are possible.

So that the inner passageway 364 may communicate with select radial channels 344, flow couplings 370 may extend across the outer passageway 366 to connect the inner passageway 364 with the select radial channels 344. In embodiments, the support collars 368 may be aligned with the select radial channels 344, and the flow couplings 370 may be holes machined through the support collars 368. Other configurations are possible. Regardless, the support collars 368 and the flow couplings 370 may be sized and shaped to permit steam to flow along the outer passageway 366. For example, the support collars 368 may have openings or slots that permit steam flow-through in the longitudinal direction 308.

In the illustrated embodiment, the inner passageway 364 forms the axial inlet channel 346 of the internal cooling path 302, which communicates steam upstream to the wheel 316. Such a configuration may facilitate cooling, as the tube 363 may contact a relatively smaller volume of steam located in the inner passageway 364 than the outer passageway 366. Thus, steam traveling upstream to cool the attachment area 322 may accept relatively less heat from the tube 363 when traveling in the inner passageway 364 than the outer passageway 366. However, in other embodiments the configuration may be reversed.

The internal cooling path described above permits cooling the attachment area between a dovetail and a bucket using steam that has already performed work in other areas of the turbine. Therefore, the rotor may be manufactured from, for example, materials that are relatively less tolerant of high-temperatures. Such materials may be relatively less expensive, decreasing the cost of the turbine. Further, a performance improvement may be realized, as the materials in the attachment area may be cooled using steam that has already performed work elsewhere in the turbine. The dovetail and the bucket may be less likely to experience creep or failure in the attachment area, improving the performance of the turbine without the performance losses associated with external cooling systems.

Although particular embodiments of systems and methods for internally cooling a wheel of a steam turbine have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims and the equivalents thereof.

At least the following is claimed:

1. A system for cooling a wheel of a steam turbine, the wheel being associated with a rotor of the steam turbine, the system comprising:

an inlet passage positioned to communicate steam from an exterior of the rotor, through an interior of the rotor, and to the wheel;

the inlet passage comprising an inlet opening located downstream of the wheel; and an outlet passage positioned to communicate steam from the wheel, through the interior of the rotor, and to the exterior of the rotor;

the outlet passage comprising an outlet opening located downstream of the wheel.

2. The system of claim 1, wherein the inlet opening is located upstream of the outlet opening, such that a pressure differential is created between the inlet opening and the outlet opening, the inlet opening being at a relatively higher pressure than the outlet opening.

3. The system of claim 1, wherein an annular channel is formed about the wheel.

4. The system of claim 3, wherein:

the inlet passage is in communication with an intake into the annular channel; and the outlet passage is in communication with an outtake out of the annular channel.

5. The system of claim 1, wherein:

the inlet passage comprises:

an axial inlet channel extending through the interior of the rotor; and a downstream radial inlet channel connecting the exterior of the rotor to the axial inlet channel;

an upstream radial inlet channel connecting the axial inlet channel to the wheel;

the outlet passage comprises:

an axial outlet channel extending through the interior of the rotor;

an upstream radial outlet channel connecting the wheel to the axial outlet channel; and a downstream radial outlet channel connecting the axial outlet channel to the exterior of the rotor.

6. The system of claim 5, wherein:

an annular channel is formed about the wheel; and the annular channel extends circumferentially about the wheel between the upstream radial inlet channel and the upstream radial outlet channel.

7. The system of claim 1, further comprising:

an axial bore extending substantially along a longitudinal axis of the rotor; and a tube positioned in the axial bore, an interior of the tube defining a portion of the inlet passage and a space between the tube and the axial bore defining a portion of the outlet passage.

8. The system of claim 7, wherein:

the axial bore is substantially cylindrical;

the tube is substantially cylindrical, a diameter of the tube being relatively smaller than a diameter of the axial bore; and the tube is concentrically mounted in the axial bore.

9. A system for cooling an attachment area of a steam turbine, the system comprising:

an annular channel extending circumferentially about the attachment area of a rotor; and an internal cooling path formed through an interior of the rotor, the internal cooling path extending from an inlet opening through the annular channel to an outlet opening;

the internal cooling path comprising:

a first axial channel on an interior of the rotor;

a second axial channel on the interior of the rotor, the second axial channel being separated from the first axial channel;

a first radial channel extending from an exterior of the rotor to the first axial channel;

a second radial channel extending from the first axial channel to an intake of the annular channel:

a third radial channel extending from an outtake of the annular channel to the second axial channel; and a fourth radial channel extending from the second axial channel to the exterior of the rotor.

10. The system of claim 9, wherein the annular channel is located upstream of the inlet opening and the outlet opening.

11. The system of claim 10, wherein the inlet opening is located upstream of the outlet opening.

12. A system for cooling a turbine, the system comprising:

an annular channel extending circumferentially about a wheel of the turbine; and an internal cooling path through an interior of a rotor of the turbine, the internal cooling path comprising:

an inlet passage positioned to communicate steam from a first downstream wheel space to the annular channel; and an outlet passage positioned to communicate steam from the annular channel to a second downstream wheel space, the second downstream wheel space being farther downstream than the first downstream wheel space, such that a pressure drop is created along the internal cooling path when the turbine is in operation.

13. The system of claim 12, further comprising:

an axial bore extending through the interior of the rotor, and a tube concentrically mounted in the axial bore, the tube separating the axial bore into two discrete passageways, one of the discrete passageways forming a portion of the inlet passage and the other of the discrete passageways forming a portion of the outlet passage.

14. The system of claim 12, further comprising a plurality of radial channels extending through the rotor, the inlet passage comprising some of the radial channels and the outlet passage comprising the other radial channels.

15. The system of claim 12, wherein:

the inlet passage comprises:

an axial inlet channel extending through the interior of the rotor; and a downstream radial inlet channel connecting the first downstream wheel space to the axial inlet channel;

an upstream radial inlet channel connecting the axial inlet channel to an intake of the annular channel;

the outlet passage comprises:

an axial outlet channel extending through the interior of the rotor;

an upstream radial outlet channel connecting an outtake of the annular channel to the axial outlet channel; and a downstream radial outlet channel connecting the axial outlet channel to the second downstream wheel space.

16. The system of claim 12, wherein the internal cooling path comprises:

a first axial channel on the interior of the rotor;

a second axial channel on the interior of the rotor, the second axial channel being separated from the first axial channel;

a first radial channel extending from the first downstream wheel space to the first axial channel;

a second radial channel extending from the first axial channel to an intake of the annular channel;

a third radial channel extending from an outtake of the annular channel to the second axial channel; and a fourth radial channel extending from the second axial channel to the second downstream wheel space.

17. The system of claim 12, wherein the annular channel extends circumferentially about the wheel adjacent a dovetail of the rotor.

* * * * *